US006688298B2

(12) United States Patent
Maeda et al.

(10) Patent No.: US 6,688,298 B2
(45) Date of Patent: Feb. 10, 2004

(54) AIR GUN MAGAZINE AND AIR GUN HAVING SAID MAGAZINE

(75) Inventors: Tetsuo Maeda, Tokyo (JP); Yoshiyuki Maeda, Tokyo (JP)

(73) Assignee: Maruzen Company Limited, Tokyo (JP)

( * ) Notice: Subject to any disclaimer, the term of this patent is extended or adjusted under 35 U.S.C. 154(b) by 0 days.

(21) Appl. No.: 10/334,708

(22) Filed: Jan. 2, 2003

(65) Prior Publication Data

US 2003/0188729 A1 Oct. 9, 2003

Related U.S. Application Data

(62) Division of application No. 10/115,971, filed on Apr. 5, 2002, now Pat. No. 6,530,368.

(51) Int. Cl.[7] ..... F41B 11/02
(52) U.S. Cl. ..... 124/48; 124/50; 124/73
(58) Field of Search ..... 124/45, 48, 49, 124/50, 51.1, 73

(56) References Cited

U.S. PATENT DOCUMENTS

| | | | |
|---|---|---|---|
| 926,546 | A | 6/1909 | Cox |
| 1,816,091 | A | 7/1931 | Schmeisser |
| 2,609,811 | A | 9/1952 | Lawrence |
| 3,547,095 | A | 12/1970 | Vadas |
| 3,741,189 | A | 6/1973 | Kester et al. |
| 3,776,903 | A | 12/1973 | Drell et al. |
| 3,782,359 | A | 1/1974 | Kester et al. |
| 4,986,251 | A | 1/1991 | Lilley |
| 4,993,400 | A | 2/1991 | Fitzwater |
| 5,285,766 | A | 2/1994 | Milliman |
| 5,722,383 | A | 3/1998 | Tippmann et al. |
| 5,816,232 | A | 10/1998 | Bell |
| 5,954,042 | A | 9/1999 | Harvey |
| 6,347,621 | B1 | 2/2002 | Guthrie |

*Primary Examiner*—John A. Ricci
(74) *Attorney, Agent, or Firm*—Foley and Lardner

(57) ABSTRACT

A magazine for an air gun of this invention can be freely attached to and detached from an air gun body using a magazine body, and has a plurality of pellet holders capable of being loaded with one pellet at a time. The plurality of pellet holders move orbitally about a pellet holder path and the pellets can be fed one at a time from the pellet holders towards a rotary sub chamber positioned below. With the air gun of this invention, the direction of the rotary sub chamber can be changed by shifting a rotary sub chamber positioned below the magazine, a trans link and a bolt forwards and backwards, so that the direction of single pellets dropping from the magazine can be changed by ninety degrees for feeding into the barrel. The magazine conveyor link is also interlocked so as to move to the front and rear in unison with movement to the front and rear of the trans link.

1 Claim, 27 Drawing Sheets

AIR GUN MAGAZINE AND AIR GUN HAVING SAID MAGAZINE

BACKGROUND OF THE INVENTION

1. Field of Invention

The present invention relates to a magazine for an air gun capable of repeat firing pellets formed of lead, etc., and an air gun having this magazine. Specifically, the present invention relates to a magazine for an air gun capable of repeat firing of pellets formed of lead etc. using compressed air and an air gun having this magazine.

2. Description of the Background Art

Conventionally, cartridge chambers for air guns employing pellets made of lead etc. are as disclosed, for, example, in U.S. Pat. No. 5,285,766 (related example 1). In a first related example 1, a rotatable loader 64 provided with a plurality of pellets 125 is disclosed. However, the loader 64 of related example 1 can be rotated taking an axis in a direction parallel to the direction of a gun barrel 50 (barrel) as center. The structure is then such that inserted pellets 125 are also inserted in the direction of the barrel and are discharged from the muzzle in the direction of insertion (refer to FIG. 3, FIG. 16 and FIG. 17 of related example 1).

Further, with a gas-operated pellet gun with removable clip loader as disclosed in U.S. Pat. No. 3,741,189 (related example 2), a configuration is adopted whereby when respective pellet chambers 119 coincide with the opening 124 while rotating the six pellet chambers 119 centrally about a post 115 facing in a direction parallel with the direction of the gun barrel 30, a pellet P is pushed out to the firing position. Pellet chambers 119 in related example 3 are also rotated centrally about a post 115 facing in a direction parallel to the direction of the gun-barrel 30 and the respective pellets are loaded into the pellet chamber 119 in advance in the direction of the gun barrel 30.

Further, a chamber (revolver barrel 36) for an air gun having a central axis of rotation in a vertical direction (a direction at right angles to the direction of the gun barrel 26) is disclosed in U.S. Pat. No. 3,547,095 (related example 3). However, pellets loaded into the pellet chambers 38 are loaded into the gun barrel 26 one at a time by rotating the six respective pellet chambers 38 of this revolver barrel 36 in a plane in the same direction as the direction of the gun barrel 26 and discharged to the gun barrel 26. Namely, the revolver barrel (member) 36 is provided with six, equiangularly spaced radial pockets or pellet chambers 38, each of which opens at its outer end on the periphery of barrel 36, and at its inner end on a post 28.(see column 1, line 66 to 69 in the related example 3).

However, with the air gun magazines disclosed in related example 1 to related example 3, the size of the respective rotating discs has to be large because the number of pellet chambers is large and this is detrimental to the balance of the air gun and makes handling difficult.

SUMMARY OF THE INVENTION

A magazine for an air gun of this invention can be freely attached to and detached from an air gun body using a magazine body, and has a plurality of pellet holders capable of being loaded with one pellet at a time. The plurality of pellet holders move orbitally about a pellet holder path and the pellets can be fed from the pellet holders towards a rotary sub chamber positioned below.

The pellets drop one at a time into the rotary pellet hole of the rotary sub chamber due to the shutter interlocked with the conveyor link opening and closing the pellet hole and the pellet holders are moved one at a time by the operation of the link latch of the conveyor link.

The air gun of this invention has a rotary sub chamber for changing the direction of single pellets falling from the magazine from a vertical direction through ninety degrees for feeding into the barrel. The rotary sub chamber is positioned at a lower part of the magazine body, is fitted to the air gun body so as to be freely rotatable about the sub chamber rotary axis, and has a sub chamber arm parallel with the sub chamber rotary axis and a rotary pellet hole constituted by a through-hole.

The rotary sub chamber is rotated through ninety degrees by a backwards and forwards shifting trans link fitted to the air gun body so that the direction of the angle of the rotary pellet hole can be changed through ninety degrees from a direction coinciding with the barrel to a direction coinciding with the pellet hole of the magazine Further, the conveyor link of the magazine is interlocked with the forward and backward movement of the trans link and also shifts forwards and backwards.

The effect of this invention is that the discharge of a large number of pellets is possible with the loading of an extremely compact magazine. Further, the loading of pellets one at a time is also possible with the magazine remaining mounted on the air gun body so that limitless consecutive firing is possible.

DESCRIPTION OF THE PREFERRED EMBODIMENTS

Figure 1:
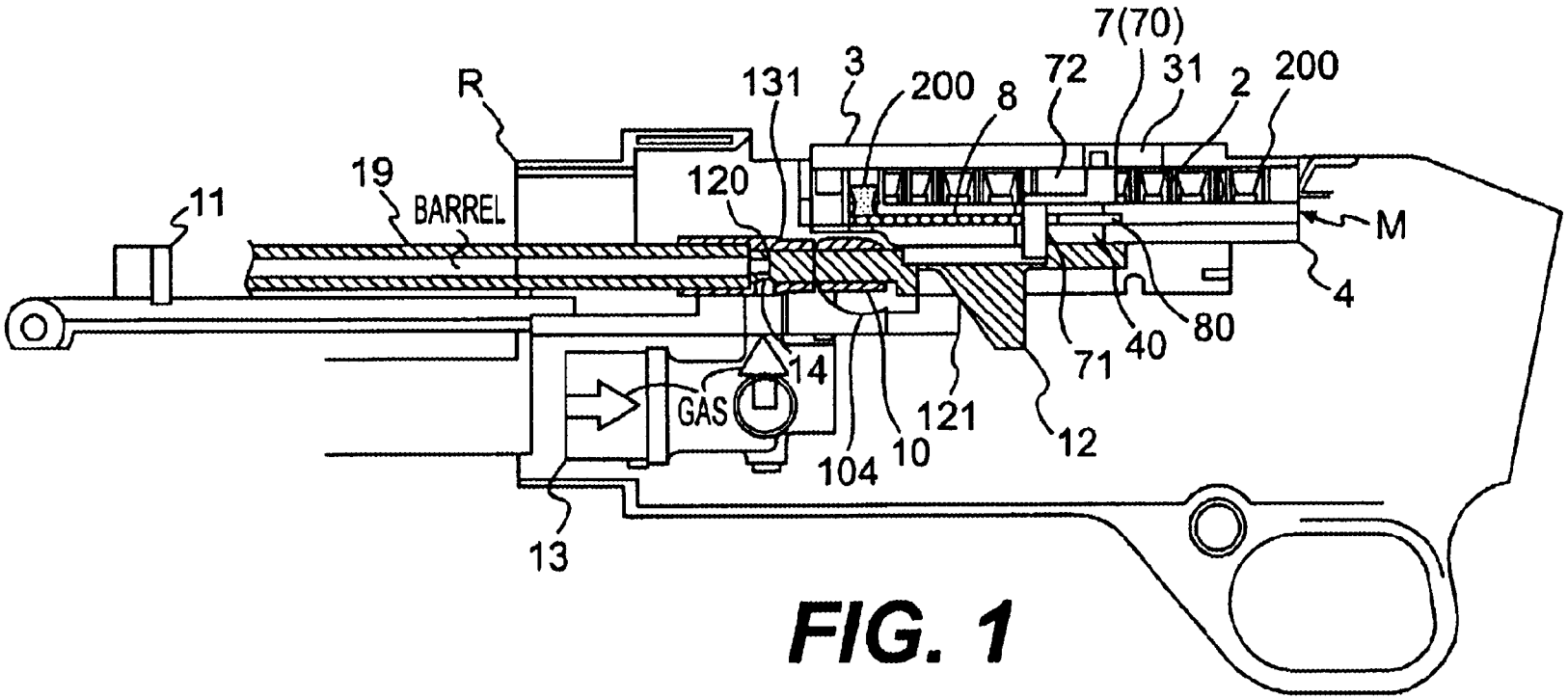
FIG. 1 shows a first embodiment of this invention and is a partial front view of an air gun with an air gun magazine mounted on the air gun body with the trans link in the foremost position.

A description is given of an air gun magazine M constituting a preferred embodiment of this invention, and an air gun having this magazine M. In this specification, the discharging side of the air gun is referred to as the front direction and the gripping side of the air gun is referred to as the rear direction. Further, the horizontal direction, vertical direction and up and down direction are described with a barrel 19 of the air gun positioned in a horizontal direction. Further, in the description regarding rotation of the rotary sub chamber 10, the expressions "clockwise rotation" and "anti-clockwise rotation" refer to when viewing from the left side of the air gun. In the description of the drawings, front view is a view of the air gun as viewed from the left side.

The air gun magazine M of the preferred embodiment of this invention is freely detachable from above a lever R of the air gun body and has a plurality of pellet holders 2 capable of being loaded with a plurality of pellets 200. The plurality of pellet holders 2 are endlessly rotatable and pellets 200 from the magazine M pass through the rotary sub chamber 10 so as to be fed one at a time into the barrel 19.

The magazine M of this invention comprises a magazine body 1, a plurality of pellet holders 2 within the magazine body 1 (in this embodiment there are 22 pellet holders 2), a pellet holder path 20 enabling orbital movement of the 22 pellet holders 2 in an endless manner, a magazine upper cover 3, a magazine under cover 4, a pellet hole 5, and a pellet holder stop 6.

The pellet holders 2 are cylindrical and open at both ends to enable lengthways loading of pellets 200 one at a time and are moved by pushing down by a link latch 72 within the path of the pellet holder path 20.

The pellet holder path 20 is comprised of an oblong path having two parallel straight line portions, with the pellet holders 2 then being moved within this path by the front to rear shifting action of the conveyor link 7.

In this embodiment, the pellet holders 2 move within the pellet holder path 20 in a clockwise direction as viewed from above, the pellet holders 2 advance at the straight line portion on the left side of the pellet holder path 20 and the right side straight line portion retracts.

The magazine upper cover 3 opens one single pellet loading port 30 above the pellet holder path 20 and is provided in a direction from front to rear at a link latch shifting groove 31 recessed at a lower surface opening.

The magazine under cover 4 has a link cover movement opening 40 formed at the middle of the pellet holder path 20.

A hole is then formed at the -magazine under cover 4 at the lower surface of the position of the foremost pellet holder 2 of the pellet holder path 20 and a pellet hole 5 is formed in the vertical direction.

The rear surface of the pellet holder stop 6 is formed with a recessed curved surface 60 corresponding to the outer surfaces of the pellet holders 2 and is urged from the front of the magazine body 1 towards the rear by a holder stop spring 61. When there is then rotational movement of the recessed curved surface 60 of the pellet holder stop 6, this rotational movement is halted at positions where the centers of the respective pellet holders 2 and the center of the pellet hole 5 coincide, the pellet holders 2 are prevented from going too far, and the center of the pellet hole 5 and the center of the pellet holders 2 are made to coincide.

The pellet holders 2 in the pellet holder path 20 are therefore rotated in an endless manner by the backward and forward action of the conveyor link 7. In this embodiment, the pellet holders 2 in the pellet holder path 20 are rotated in a clockwise direction as viewed from above.

The conveyor link 7 comprises a link body 70 provided in a horizontal direction and a conveyor link bar 71 projecting downwards at right angles from the link body 70 in the shape of an upside down L, and the link body 70 and conveyor link bar 71 are formed in an integral manner. A lower end of the link bar 71 projects downwards by a few mm from the link bar movement opening 40 provided in a longitudinal manner at a central part of the magazine under cover 4, and the lower end of the link bar 71 is positioned at the center of a shifting groove 121 of a bolt 12 (described later).

The conveyor link 7 has a conveyor link latch 72 at an upper part. The conveyor link latch 72 is provided within the oblong-shaped pellet holder path 20, has a central axis 720 at a rear part, and has a pivoting abutment member 721 rotating centrally about this central axis 720 at a front part. An upper part of the central axis 720 of the conveyor link latch 72 engages with the link latch shifting groove 31 of the magazine upper cover 3, and is capable of shifting to the front and rear along this groove.

The conveyor link latch 72 is urged towards one side by a conveyor link latch spring 73. In this embodiment, the conveyor link latch 72 is normally urged towards the left by the conveyor link latch spring 73. Therefore, when the conveyor link bar 71 of the conveyor link 7 advances, the conveyor link latch 72 is urged in a direction towards the left as viewed in a plane by the conveyor link latch spring 73, and the end of the pivoting abutment member 721 of the conveyor link latch 72 comes into close contact with the rear surface of the circumferential surface of one of the pellet holders 2. The end of the pivoting abutment member 721 of the conveyor link latch 72 then presses one pellet holder 2 towards the front due to the advancing of the conveyor link 7. All of the pellet holders 2 then rotate in a clockwise direction within the pellet holder path 20 due to the shifting of the one pellet holder 2.

Conversely, when the conveyor link bar 71 of the conveyor link 7 retracts, the end of the pivoting abutment member 721 of the link latch 72 comes into contact with the rear surface of the circumferential surface of the pellet holder 2 so as to cause retraction but the center of the pellet hole 5 and the center of the pellet holder 2 coincide and the pellet holder stop 6 therefore forms a wall, and the occurrence of all of the pellet holders 2 causing the pellet holder path 20 to rotate in an anti-clockwise direction (rotate in reverse) is avoided.

A shutter 8 constituted by a plate is provided at the upper surface of the magazine under cover 4 of the magazine body 1. The shutter 8 can be made to advance and retract within a shutter path 80 in a horizontal direction constituted by a gap provided between the lower surface of the magazine body 1 and the magazine under cover 4. The shutter 8 engages with the conveyor link 7 so as to shift in unison to the front and real of the conveyor link 7. i.e. when the conveyor link 7 advances, the shutter 8 is also interlocked and therefore advances, and when the conveyor link 7 retracts, the shutter 8 is also interlocked and therefore also retracts.

The pellet hole 5 is provided in the vertical direction with the shutter path 80 opening at a side surface. The end of the shutter 8 is capable of entering into the pellet hole 5 from a side surface opening 50 of the pellet hole 5.

Numeral 9 indicates a space cover. The space cover 9 is provided at the same level position as the shutter path 80 and comprises two (left and right) cover members 9, 9 urged from the left and right sides of the shutter path 80 towards the center by cover springs 90, 90. The cover members 9, 9 consist of plates of substantially the same thickness as the shutter 8 and form a quarter-circular recessed curved surface 91 when viewed in a plane from the front, with the two cover members 9, 9 being urged towards the center so as to make contact and form a semi-circular curved surface when viewed in a plane. This curved surface that appears as a semi-circle when viewed in a plane formed in this manner is a curved surface of the same rate of curvature as the inner surface of the pellet hole 5 and covers the side surface opening 50 of the pellet hole 5. The respective cover members 9, 9 are provided with notches in straight lines in a direction towards the rear, so as to form a groove 92 that is V-shaped when viewed in a plane with the two cover members urged in a direction towards the center so as to make contact.

The rotary sub chamber 10 is provided at the lower part of the magazine body 1, has a rotary pellet hole 100 constituted by a through-hole at its center, and is attached to the air gun body in a freely rotatable manner by a sub chamber rotary axis 101 provided in a horizontal direction from left to right. The rotary sub chamber 10 has a sub chamber arm 102 in parallel with the sub chamber rotary axis 101, with the sub chamber arm 102 being shorter in a direction from left to right than the sub chamber rotary axis 101. The chamber rotary axis 101 is provided with a plate or coil-shaped spring 103, with one end making contact with part of the lower surface of the air gun body centered about the sub chamber rotary axis and the other end making contact with the upper surface of the sub chamber arm 102.

Numeral 104 is a pellet stop slope formed with an upper surface that is a recessed curved surface with substantially the same rate of curvature as the arc of rotation of the lower surface of the rotary sub chamber 10, so that when the rotary sub chamber 10 is rotated centrally about the sub chamber rotary axis 101, the bottom surface of the rotating rotary pellet hole 100 is covered.

The trans link 11 is provided at the air gun body, and has a front part consisting of a long and slender plate, and a rear part divided between left and right portions, with the rotary sub chamber 10 being provided at the central part of the left and right portions. A trans link convex portion 110 is formed on both the left and right sides, or either one of the left or right side, of the rear part of the trans link 11. The trans link 11 is provided at the lower part of the magazine body 1 so as to be freely shiftable to the front and rear and is fixed at the rear part using a bolt 12. The bolt 12 is provided with a bolt nozzle 120 at a front end, and is provided with a link bar shifting groove 121 that opens at the upper surface and is long in a direction from front to rear. The bolt nozzle 120 is capable of passing through the rotary pellet hole 100 of the rotary sub chamber 10. The link bar shifting groove 121 engages with the lower end of the magazine link bar 71, provides a time difference for the shifting from front to rear of the trans link 11 by pressing the conveyor link bar 71 using both front and rear walls of the groove that is long in a direction from front to rear, and synchronizes the shifting to the front and the rear of the conveyor link 3.

In FIG. 1 and FIG. 2, and FIG. 18 and FIG. 19, the trans link 11 is in a state of being manually moved to the foremost position and the rotary sub chamber 10 has mounted the horizontal plane-shaped trans link convex on the left and right or one side of the trans link 11. At this time the rotary pellet hole 100 is in the horizontal direction, and the nozzle 120 of the bolt 12 passes through the rotary pellet hole 100 from the rear.

When the trans link 11 at the foremost position is shifted towards the rear through a manual operation, the bolt 12 that is fixed to the trans link 11 also moves in unison towards the rear. The bolt nozzle 120 of the bolt 12 is also detached from the rotary pellet hole 100 as a result of this movement towards the rear of the bolt 12.

The bolt nozzle 120 of the bolt 12 then detaches from the rotary pellet hole 100 and the sub chamber arm 102 of the rotary sub chamber 10 comes off the trans link convex 110 of the trans link 11. In doing so, the rotary sub chamber 10 is rotated anti-clockwise through ninety degrees centered about the sub chamber rotary axis 101 due to the urging force of the rotary sub chamber spring 103 from the front. At this time, the lower surface of the rotary sub chamber 10 is rotated along the rotary sub chamber slope 104 so that when the trans link 11 shifts as far as the rearmost part, the rotary pellet hole 100 is halted in a state facing in a vertical direction.

When the trans link 11 is again shifted to the front, a front wall 110*a* of the trans link convex 110 of the trans link 11 collides with the sub chamber arm 102 and is pushed up as it is towards the front. This movement is resisted by the urging force of the rotary sub chamber spring 103 and the rotary sub chamber 10 is rotated in a clockwise direction centered about the sub chamber rotary axis 101. The sub chamber arm 102 then moves towards the front so as to mount the trans link convex 110 of the trans link 11, and the bolt nozzle 120 of the bolt 12 passes through the rotary pellet hole 100 that is in a horizontal state.

Next, the combined operation of the magazine M, rotary sub chamber 10 and pellets 200 of the air gun of the embodiment of the invention is described using FIG. 1 to FIG. 14.

The pellets 200 are loaded one at a time into the pellet holders 2 from the pellet loading port 30 as a result of rotation of the pellet holder path 20.

Figure 2:
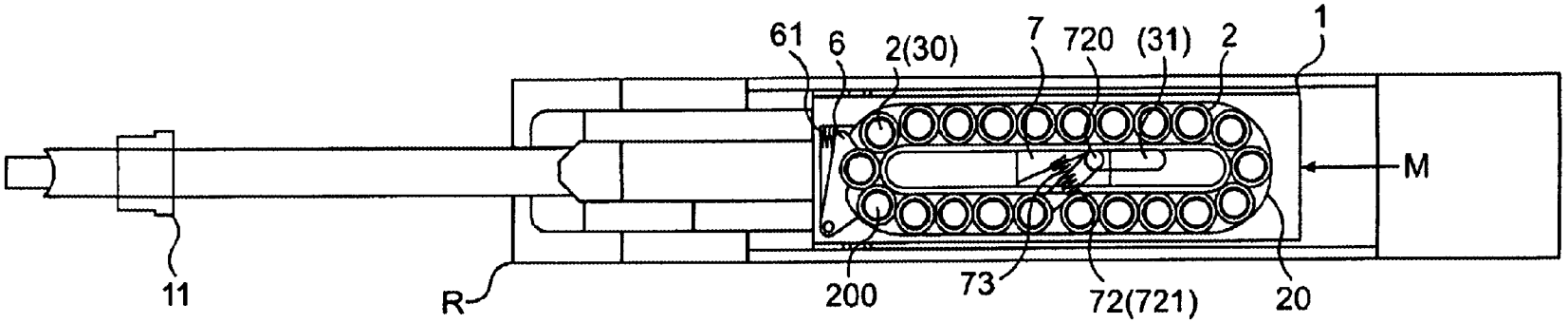
FIG. 2 is an explanatory plan view with the magazine upper cover of FIG. 1 removed.

In FIG. 1 and FIG. 2, a magazine body 1 with pellets 200 loaded into all of the pellet holders 2 is loaded from above the receiver R of the air gun body with the trans link 11 and bolt 12 in their foremost positions.

At this time, the lower part of the link bar 71 of the magazine engages with the link bar shifting groove 121 of the bolt 12. The lower part of the link bar 71 then makes contact with a rear wall surface 121*b* of the link bar shifting groove 121.

The pellet hole 5 of this magazine is closed over by the shutter 8, with one pellet 200 mounting the upper surface of the plate of the shutter 8 and stopping.

Figure 3:
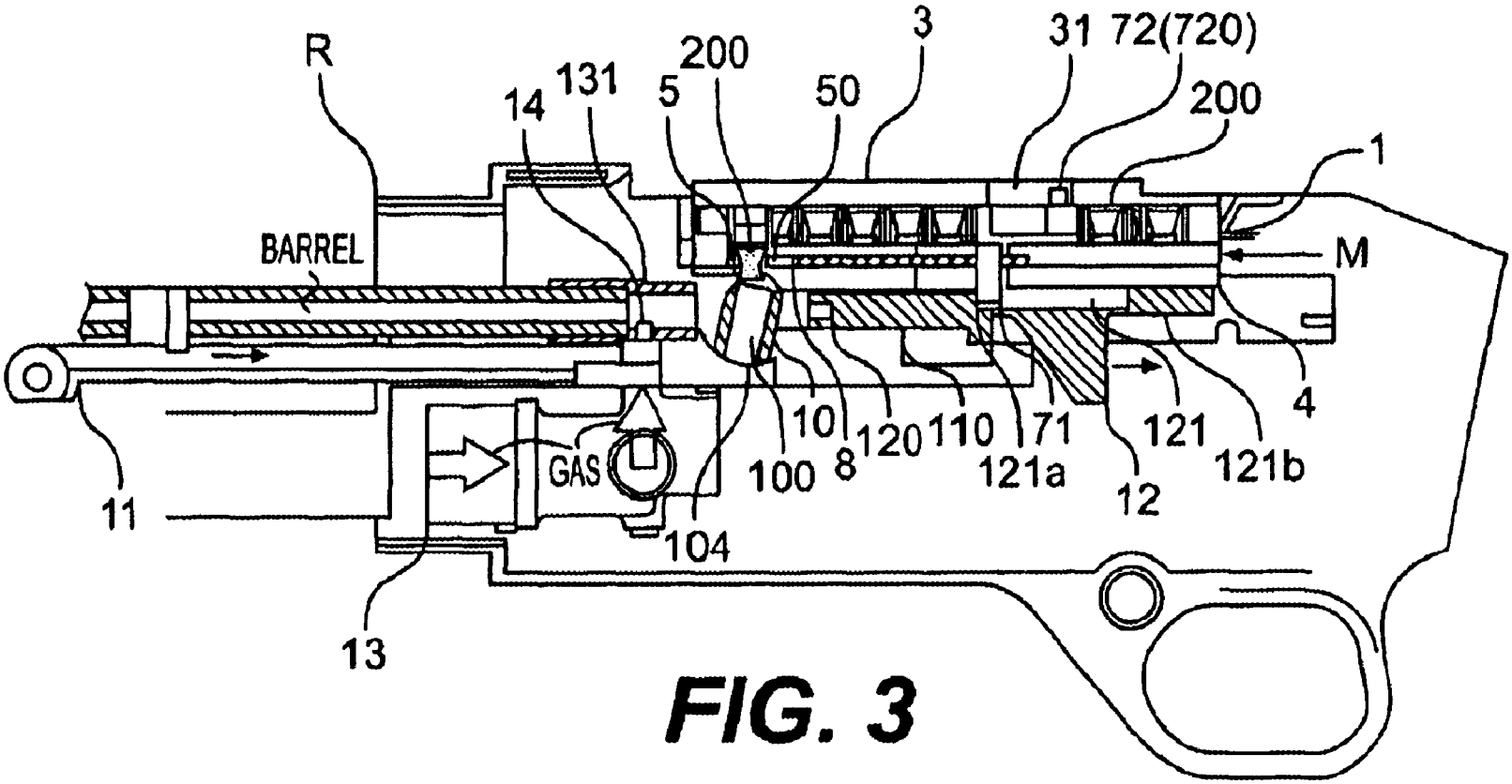
FIG. 3 is a partial front view of the air gun with the same trans link being positioned midway when shifting towards the rear.
Figure 4:
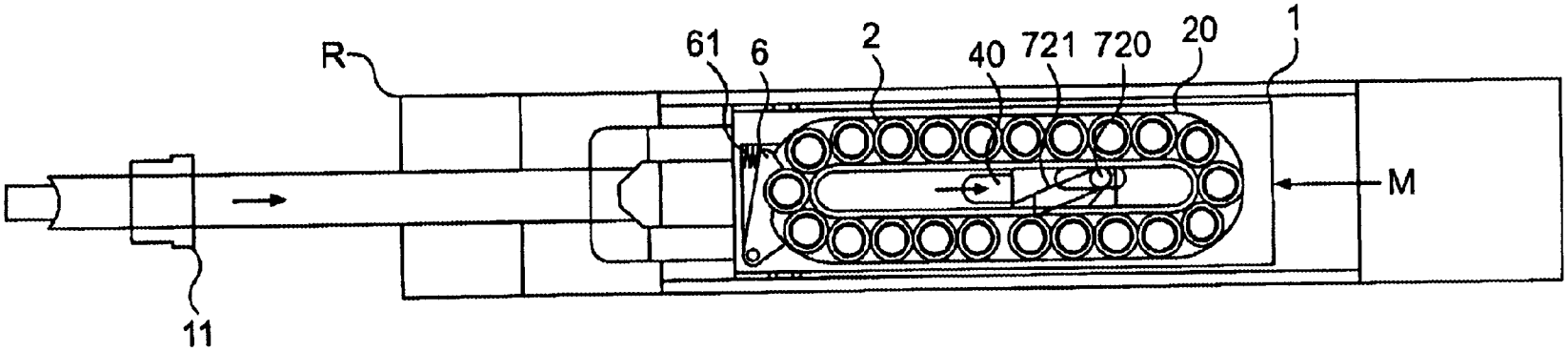
FIG. 4 is an explanatory plan view with the magazine upper cover of FIG. 3 removed.

FIG. 3 and FIG. 4 are views showing when the trans link 11 and the bolt 12 are midway through shifting towards the rear. The retracted trans link 11 and the interlocked and retracted bolt nozzle 120 are withdrawn towards the rear from the rotary pellet hole 100, the rotary sub chamber 10 comes off from the trans link convex from the front, the rotary sub chamber 10 is rotated anti-clockwise through ninety degrees centrally about the sub chamber rotary axis 101 due to the urging force of the sub chamber spring 103, and the rotary pellet hole 100 faces in a vertical direction. At the same time, the lower part of the link bar 71 is pushed to the rear by the front wall surface 121*a* of the link bar shifting groove 121, the shutter 8 interlocking with the conveyor link 7 retracts, the pellet hole 5 is opened and a pellet 200 falls into the rotary pellet hole 100 under its own weight.

The link latch 72 retracts without causing the pellet holder 2 to move.

Figure 5:
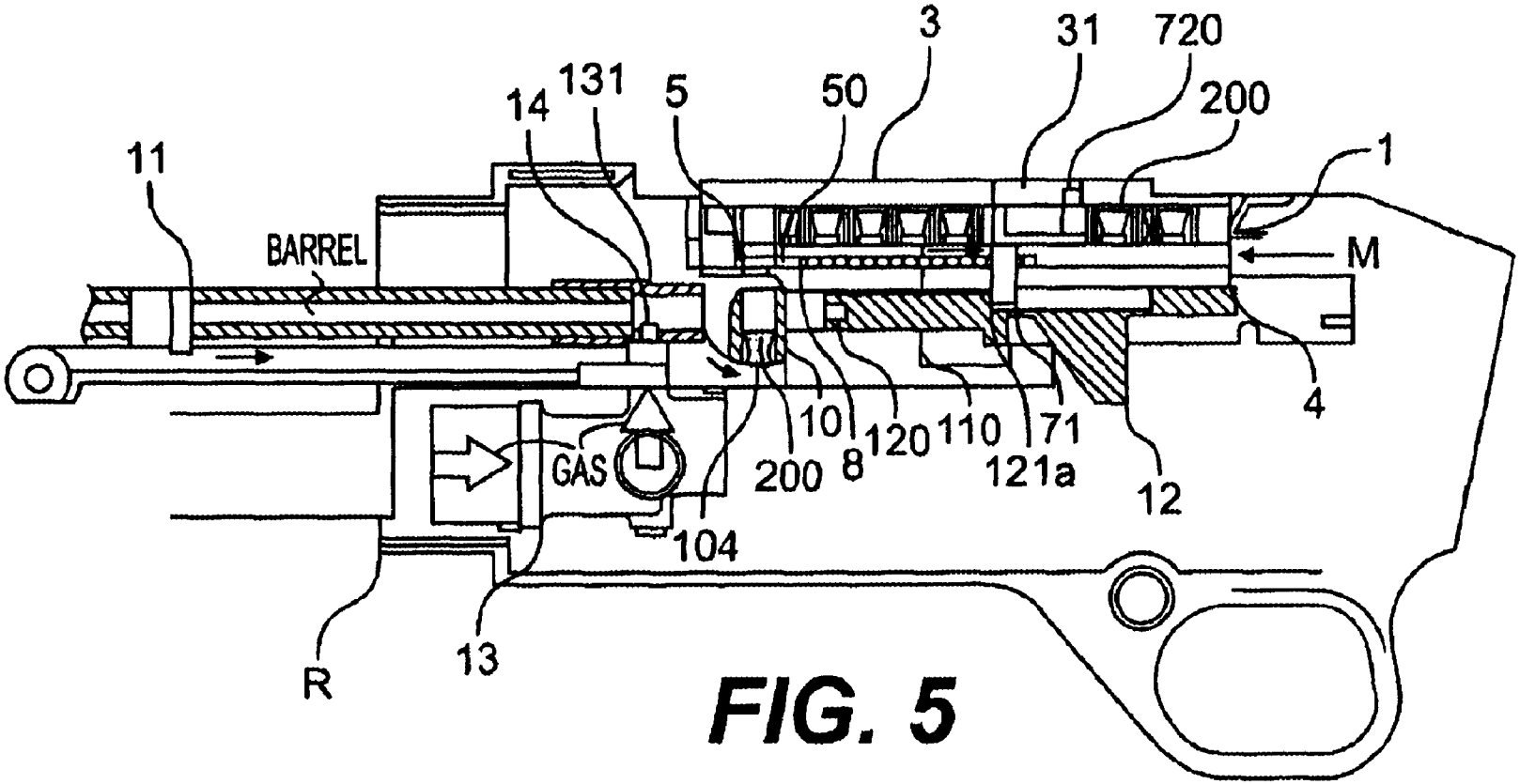
FIG. 5 is a partial front view of the air gun with the same trans link being at the rearmost position.
Figure 6:
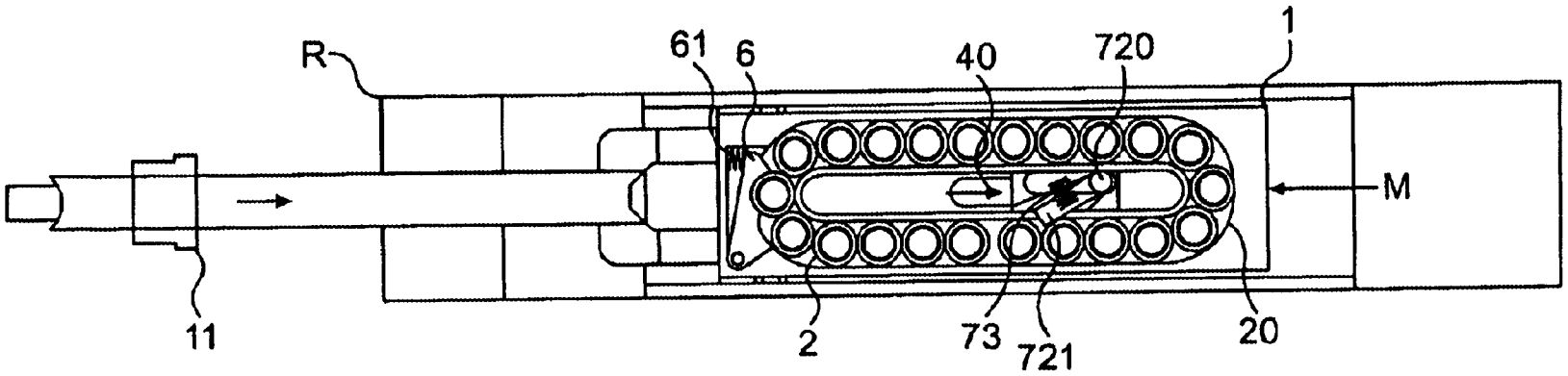
FIG. 6 is an explanatory plan view with the magazine upper cover of FIG. 5 removed.
Figure 7:
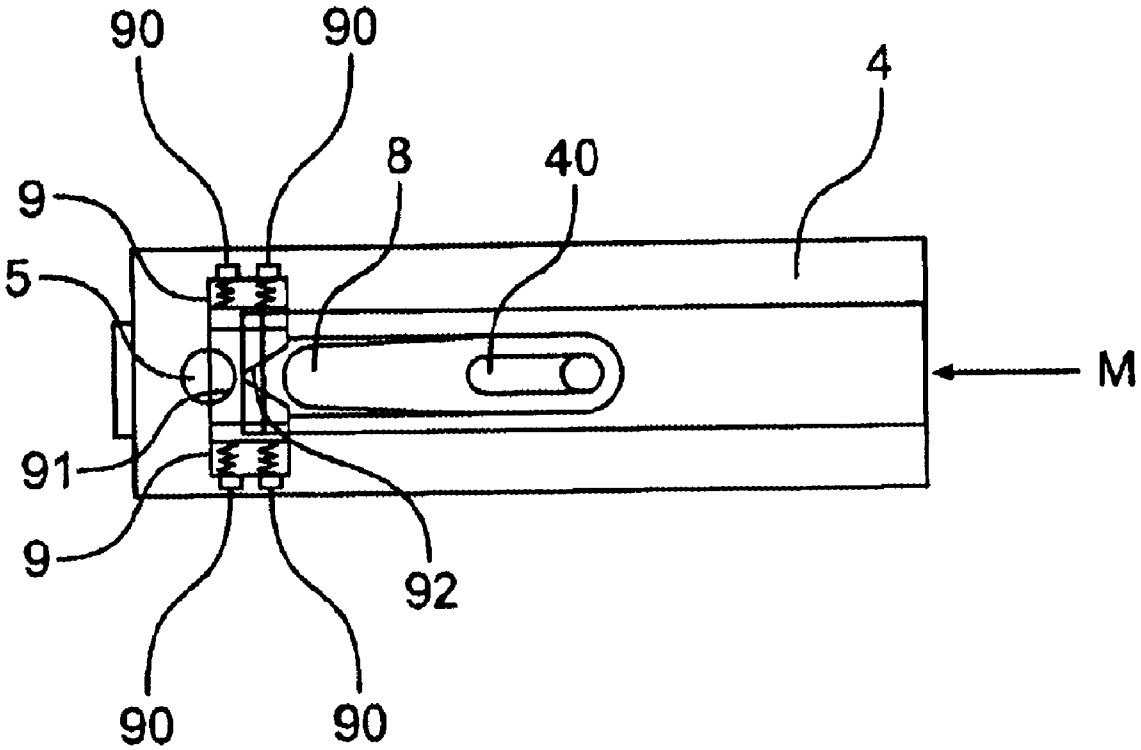
FIG. 7 is a bottom view of the magazine with the same trans link being at the rearmost position.

FIG. 5, FIG. 6 and FIG. 7 are views showing the state when the trans link 11, bolt 12 and conveyor link 7 have shifted to their rearmost positions. In this state, the rotary pellet hole 100 of the rotary sub chamber 10 faces in the vertical direction and the pellet 200 that falls in enters from above. At this time the pellet 200 is loaded on the pellet stop slope 104 at the bottom surface of the rotary pellet hole 100.

The lower part of the link bar 71 is then stopped while making contact with the front wall surface 121*a* of the link bar shifting groove 121.

At this time the side surface opening 50 of the pellet hole 5 opened by the retraction of the shutter 8 is closed by the space cover 9 and snagging of the pellet 200, it is intended to make fall is prevented (refer to FIG. 7).

Figure 8:
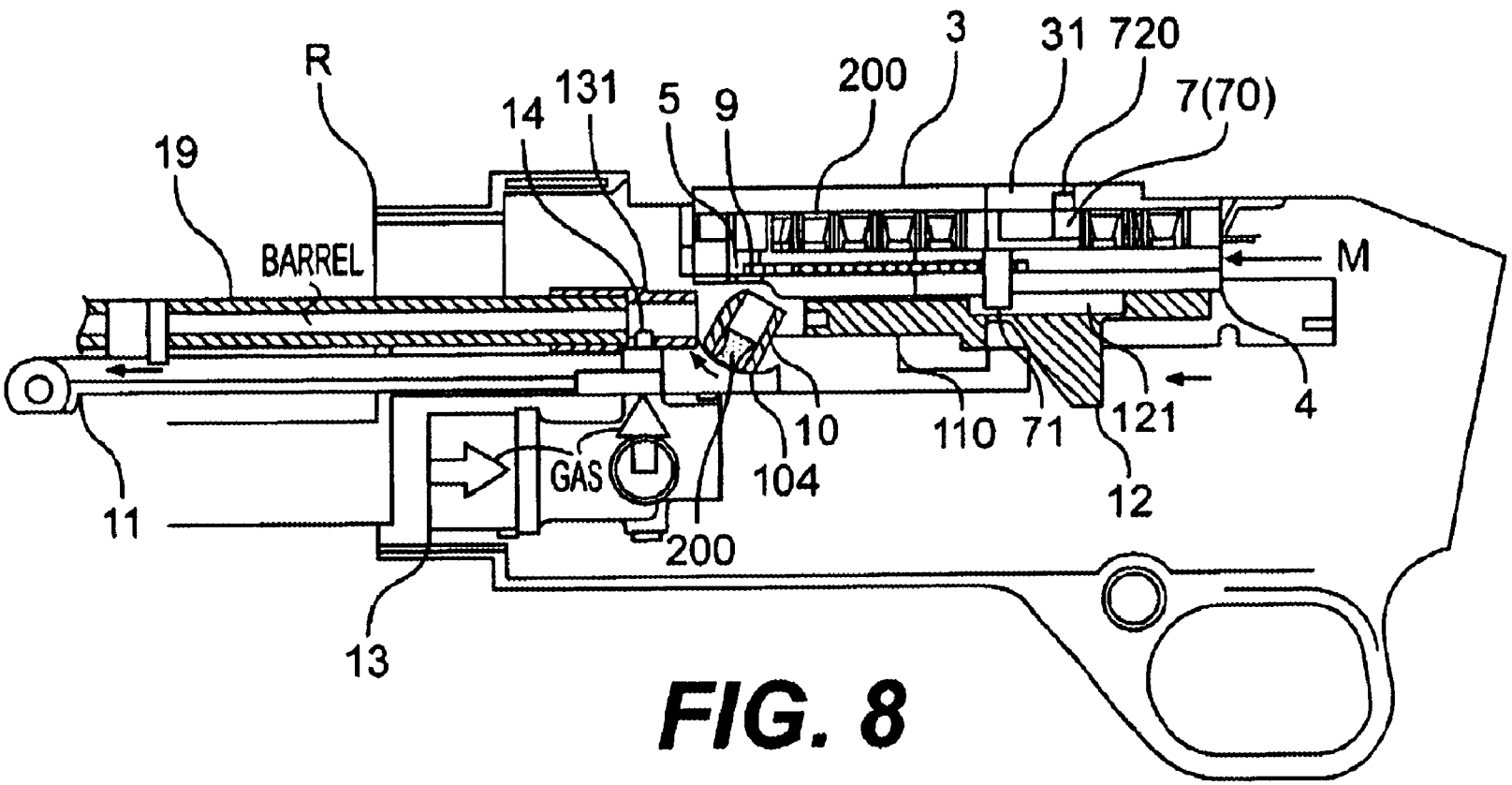
FIG. 8 is a partial front view of the air gun with the same trans link being positioned midway when shifting towards the front.
Figure 9:
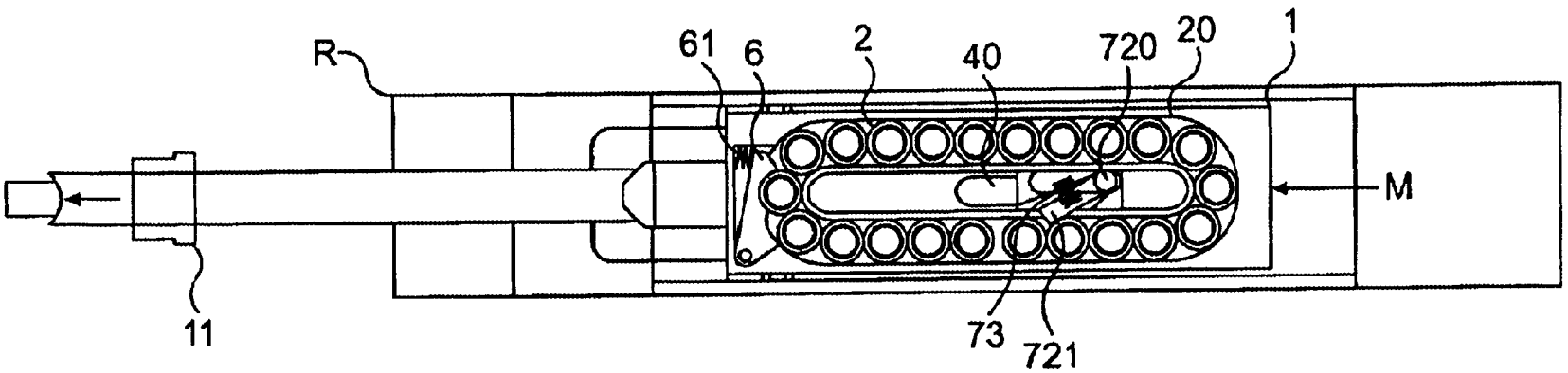
FIG. 9 is an explanatory plan view with the magazine upper cover of FIG. 8 removed.

In FIG. 8 and FIG. 9, when the trans link 11 is shifted to the front, first, a front wall 110*a* of the trans link convex 110 of the trans link 11 collides with the sub chamber arm 102 and is pushed up as it is towards the front. This movement is resisted by the urging force of the rotary sub chamber spring 103 and the rotary sub chamber 10 is rotated in a clockwise direction centered about the sub chamber rotary axis 101. At this time the pellet 200 slides onto the recessed curved surface of the pellet stop slope 104 at the bottom surface of the rotary pellet hole 100.

Further, the lower part of the conveyor link bar 71 does not yet make contact with the rear wall surface 121*b* from the front wall surface 121*a* of the link bar shifting groove 121 and the conveyor link 7 and the shutter 8 are in a halted state.

Figure 10:
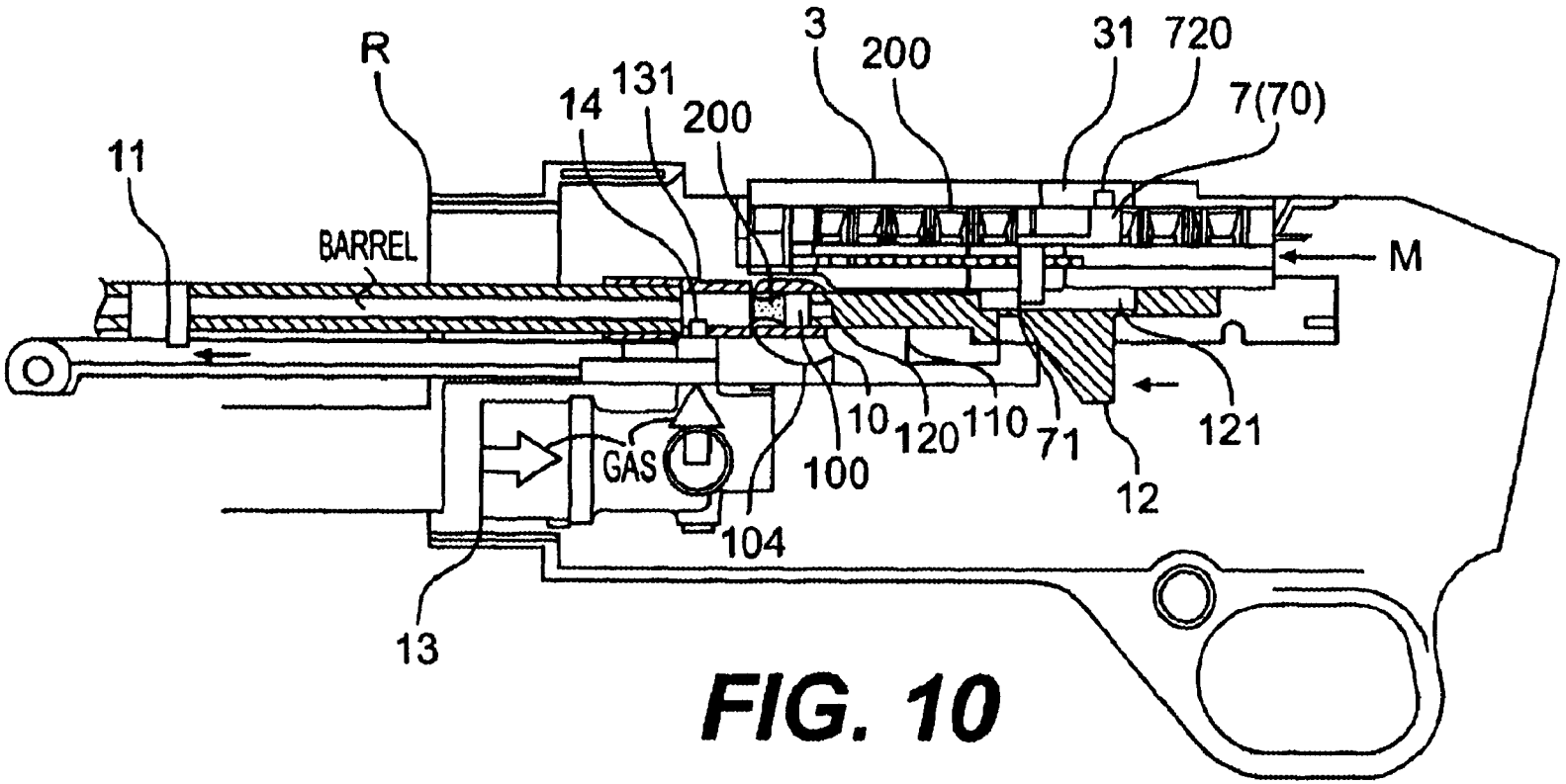
FIG. 10 is a partial front view of the air gun with the same trans link being positioned midway when shifting towards the front.
Figure 11:
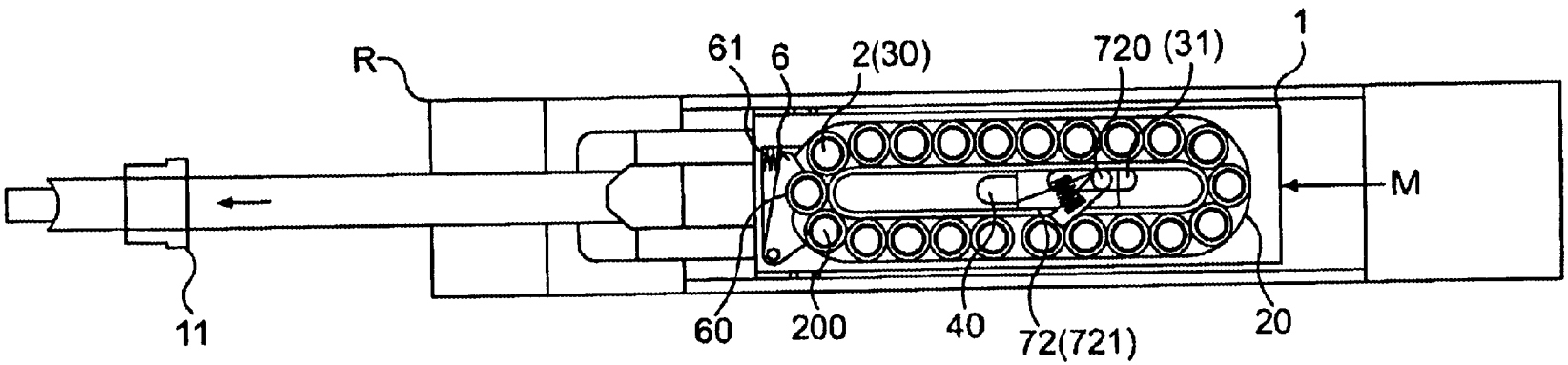
FIG. 11 is an explanatory plan view with the magazine upper cover of FIG. 10 removed.

In FIG. 10 and FIG. 11, the rotary sub chamber 10 resists the urging force of the rotary sub chamber spring 103 due to movement of the trans link 11 towards the front, the rotary sub chamber 10 is rotated in a clockwise direction centered about the sub chamber rotary axis 101, the rotary pellet hole 100 faces in a horizontal direction, and the front of the pellet 200 inside faces the barrel.

At this time, the lower part of the conveyor link bar 71 does not yet make contact with the rear wall surface 121*b* from the front wall surface 121*a* of the link bar shifting groove 121 and the conveyor link 7 and the shutter 8 are in a halted state.

Figure 12:
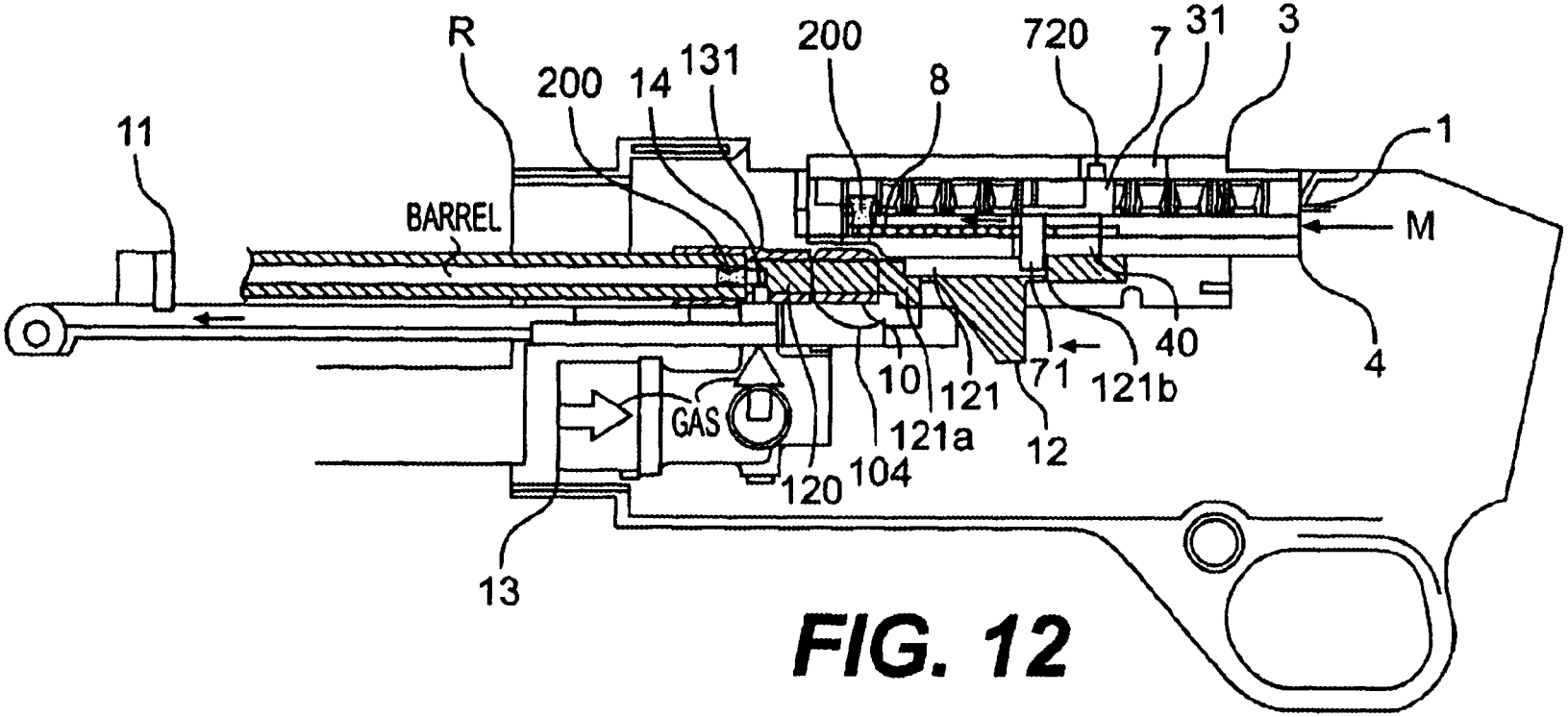
FIG. 12 is a partial front view of the air gun with the same trans link again being at the foremost position.
Figure 13:
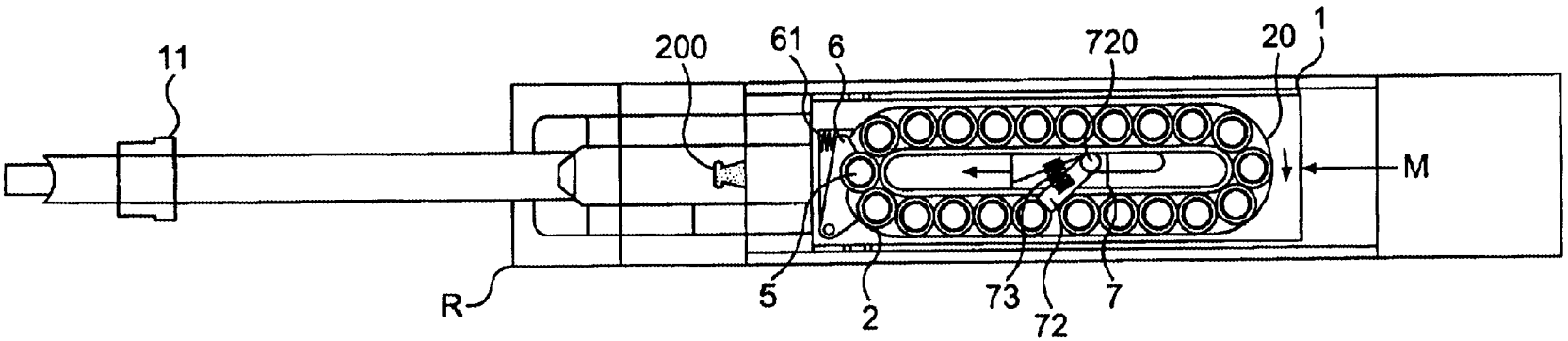
FIG. 13 is an explanatory plan view with the magazine upper cover of FIG. 12 removed.
Figure 14:
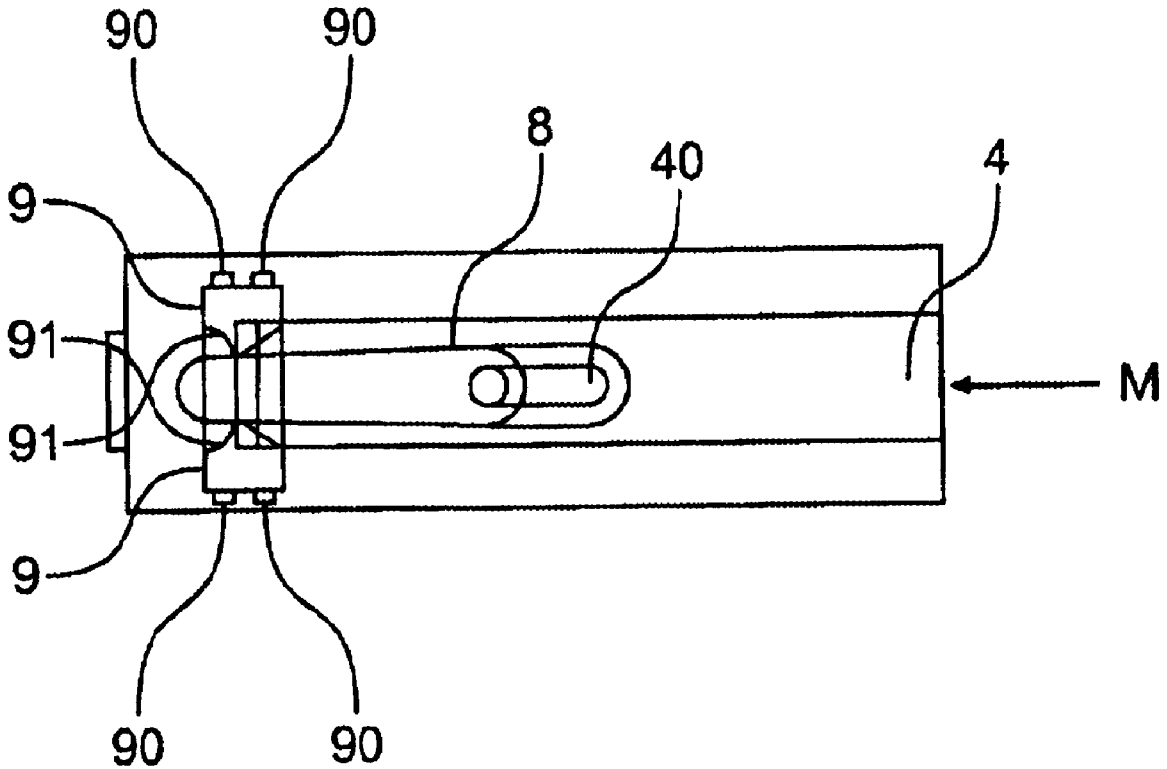
FIG. 14 is a bottom view of the magazine with the same trans link being at the foremost position.
Figure 15:
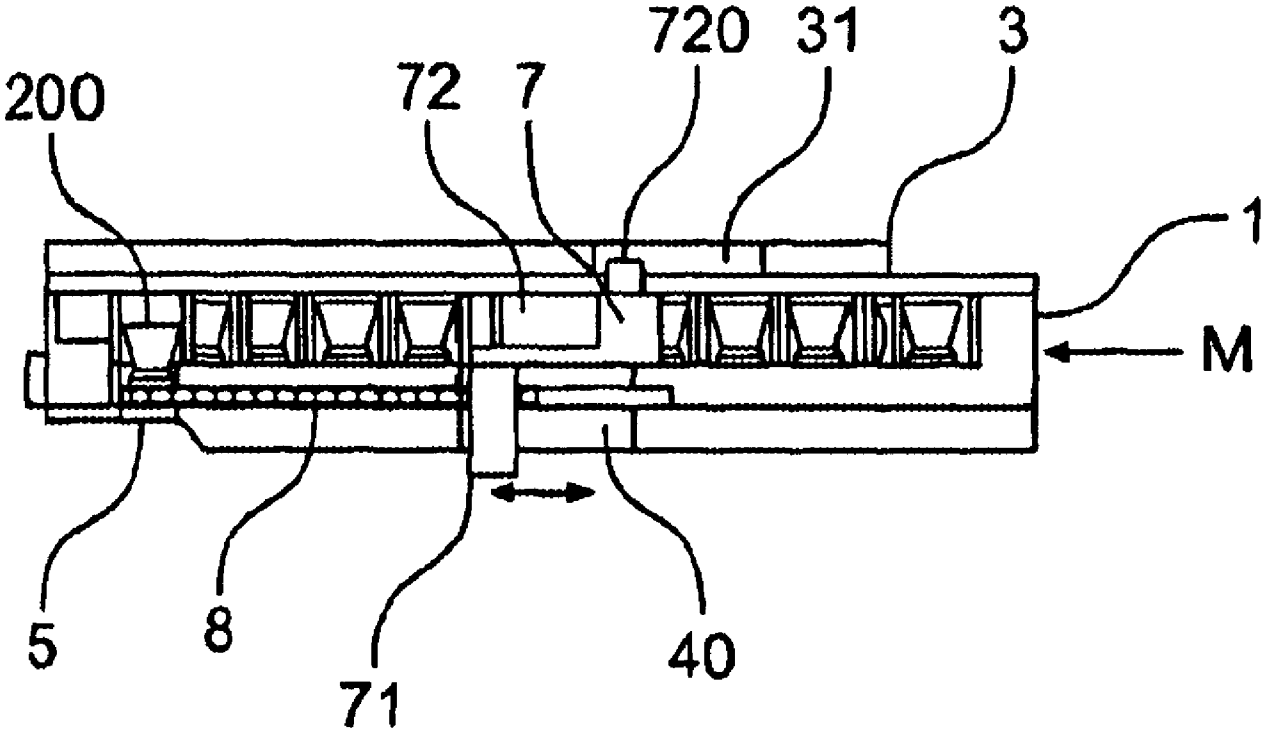
FIG. 15 is a front view of a magazine of the first embodiment of this invention.
Figure 16:
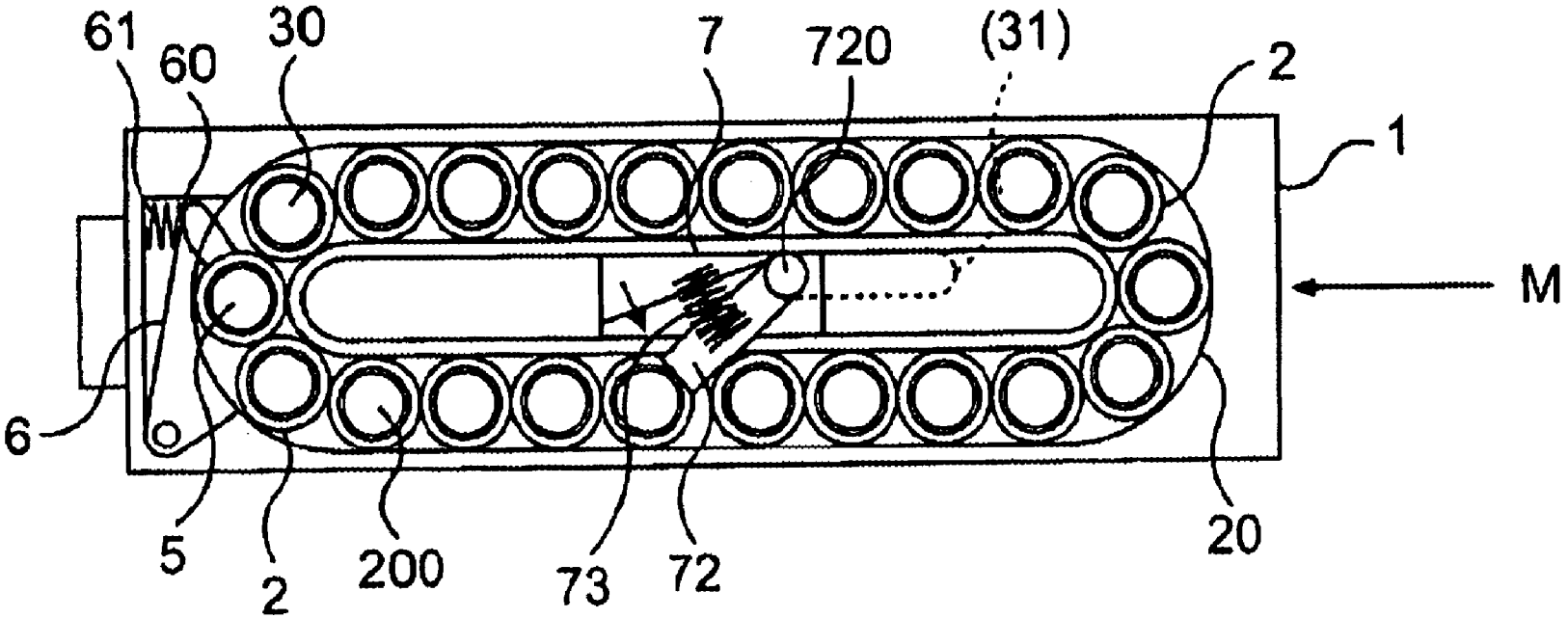
FIG. 16 is an explanatory plan view with the magazine upper cover of FIG. 15 removed.
Figure 17:
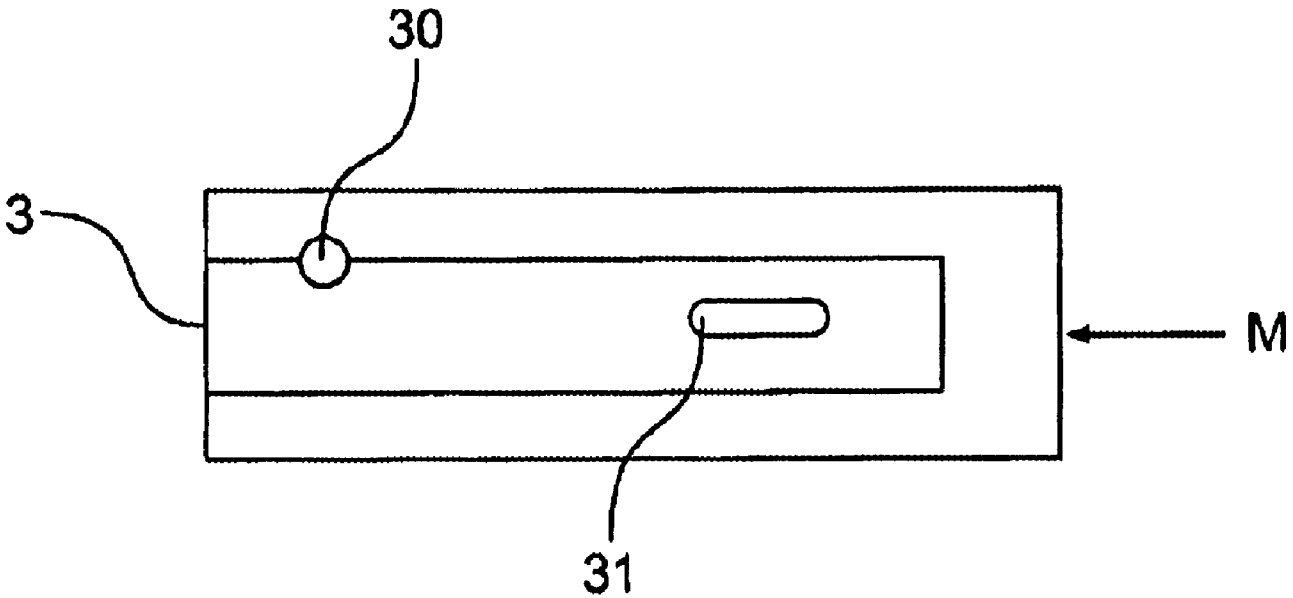
FIG. 17 is an explanatory plan view of the magazine upper cover.
Figure 18:
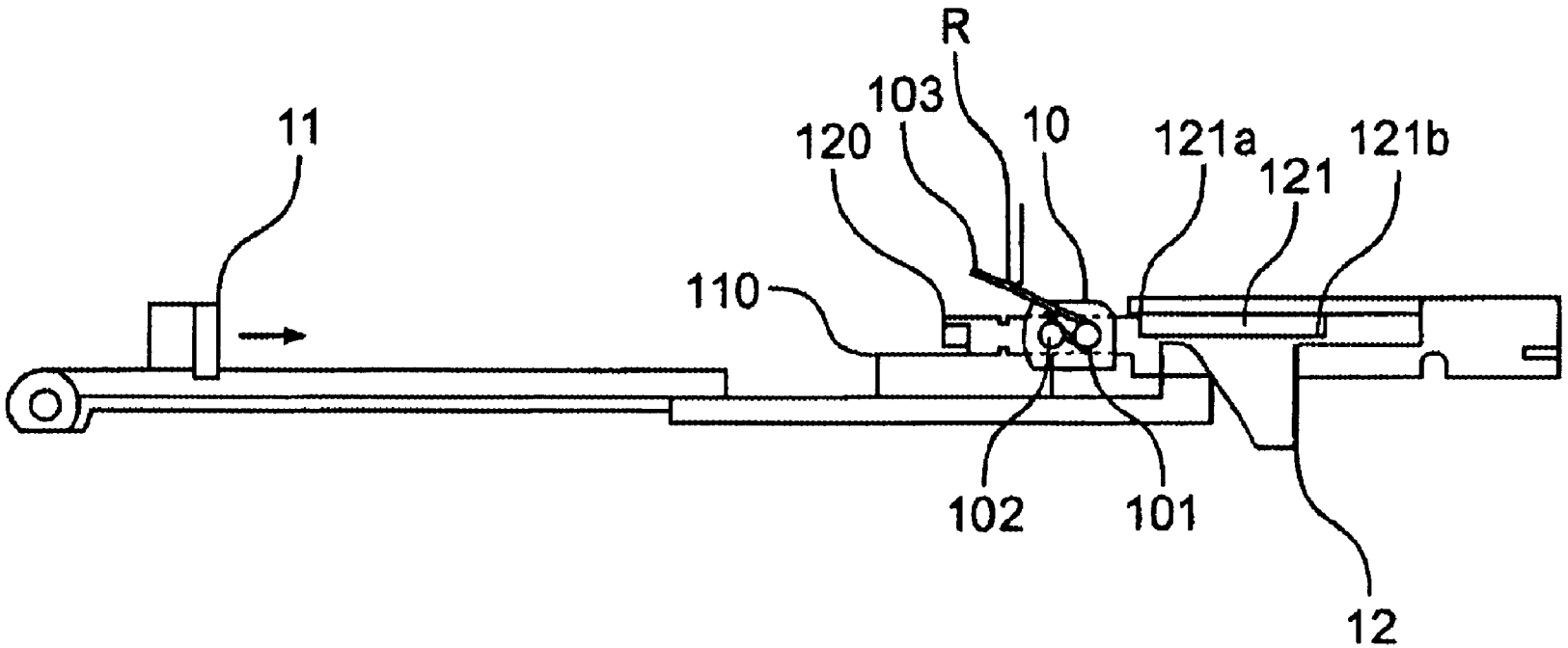
FIG. 18 shows the first embodiment of this invention, shows the movement of the trans link, bolt, and rotary sub-chamber, and is a left side view illustrating the operation when the trans link and bolt are at the foremost position.
Figure 19:
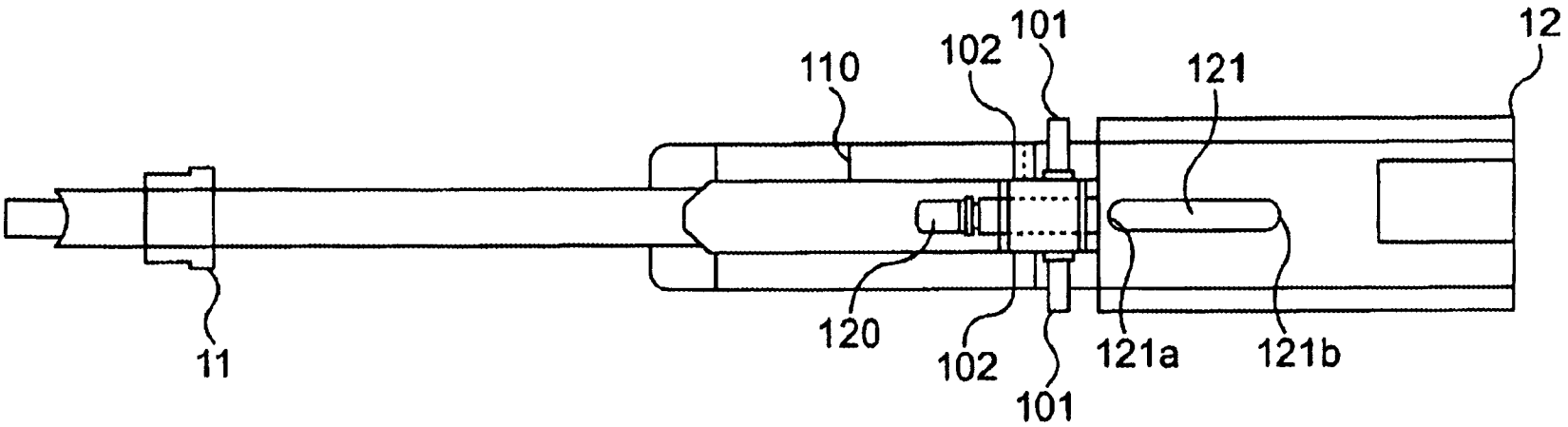
FIG. 19 is a plan view of that shown in FIG. 18.
Figure 20:
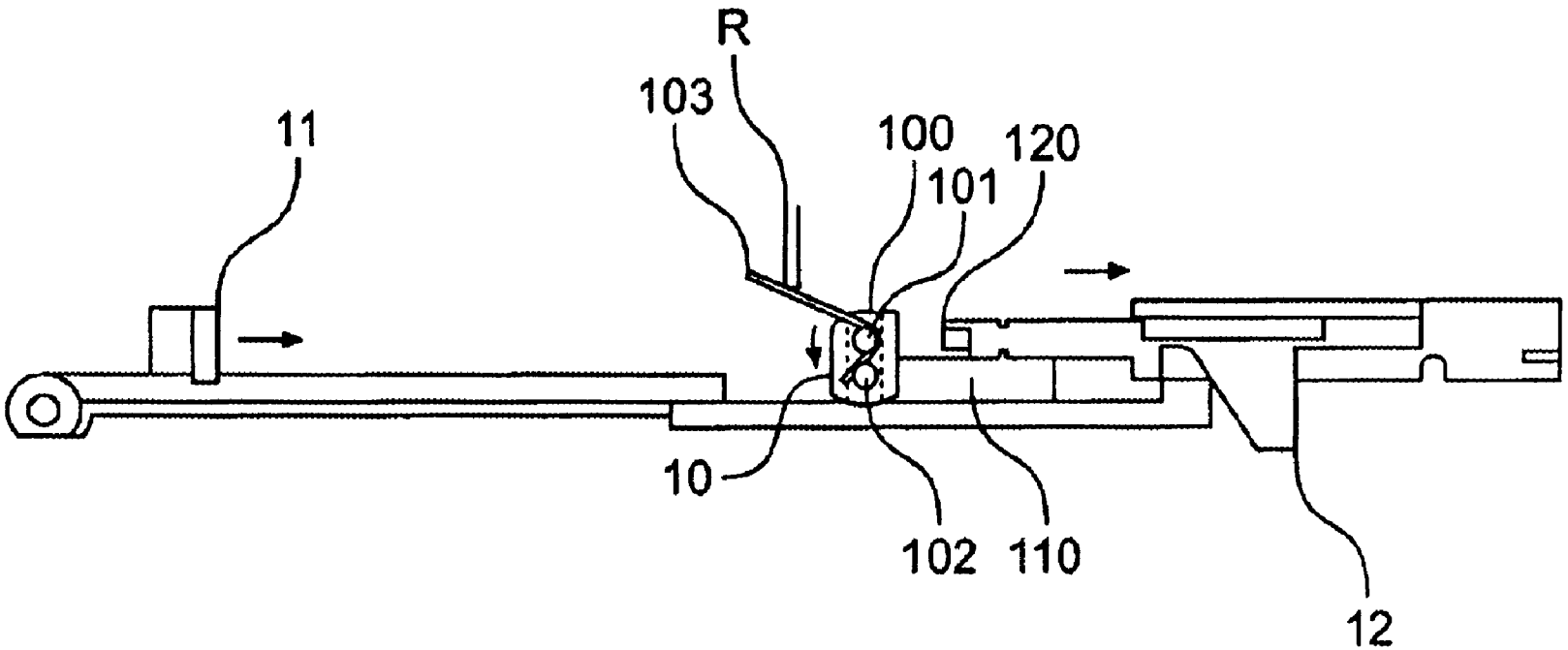
FIG. 20 is a front view showing the movement of the trans link, bolt, and rotary sub-chamber, and illustrating the operation when the trans link and bolt are at the rearmost position.
Figure 21:
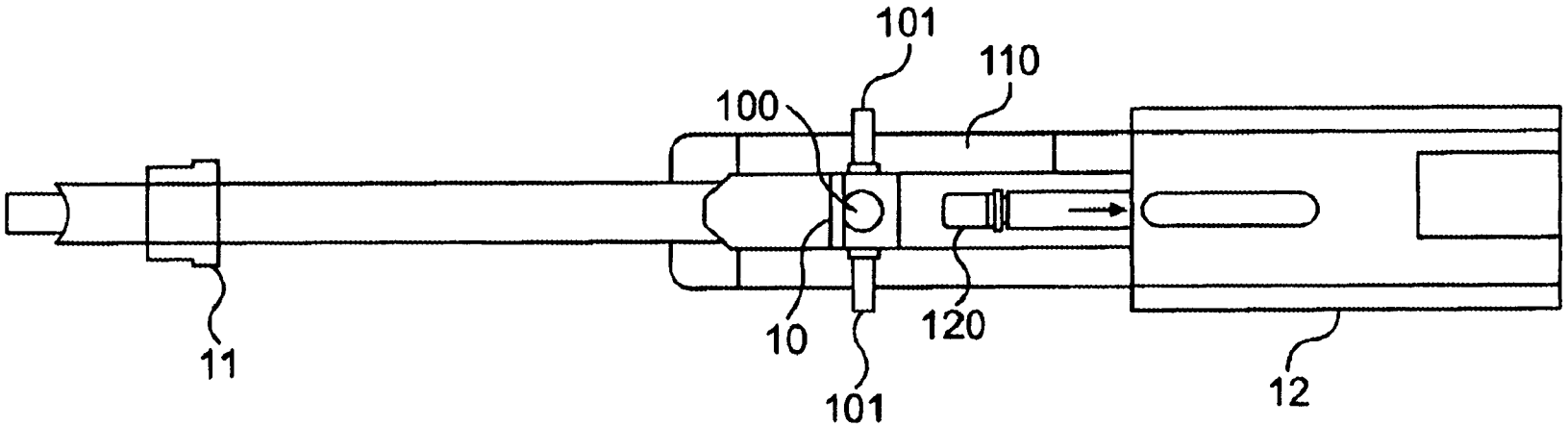
FIG. 21 is a plan view of that shown in FIG. 20.
Figure 22A:
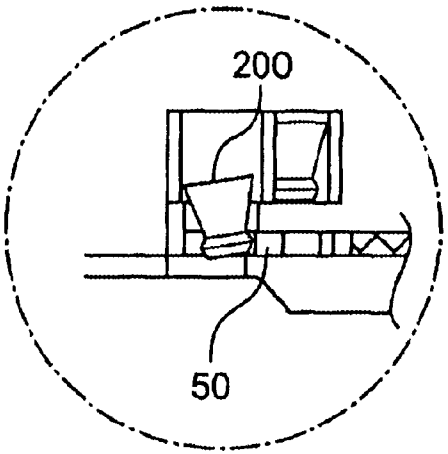
FIG. 22 is a partial view showing snagging when there is no space cover.
Figure 22:
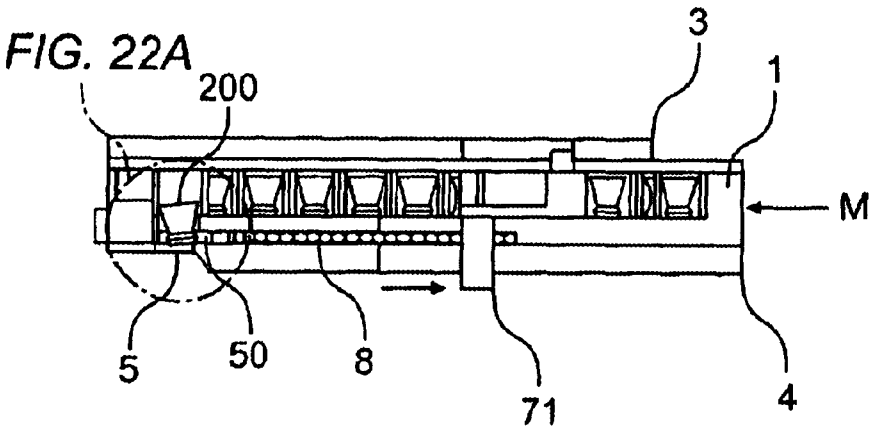

FIG. 12, FIG. 13 and FIG. 14 show the state when the trans link 11 again moves to the foremost position. The bolt nozzle 120 of the bolt 12 passes through the rotary pellet hole 100 and the pellet 200 within is pushed out into the chamber 131.

The pellet 200 that enters into the chamber 131 is then discharged through the barrel 19 by compressed gas from a compressed gas jet hole 14 due to the operation of a trigger 17. The chamber 131 is an integral portion of a valve body assembly 13 (described later).

The lower part of the link bar 71 then comes into contact with the rear wall surface 121*b* of the link bar shifting groove 121 so as to be pushed forward. The shutter 8 interlocking with the conveyor link 7 also shifts forward due to the shifting of the conveyor link bar 71 and the pellet hole 5 is closed.

The conveyor link latch 72 also advances together with the conveyor link 7. The conveyor link latch 72 is usually urged towards the left when viewed in a plane by the link latch spring 73, with the front end coming into contact with the rear surface of one of the pellet holders 2 so as to push forward in accordance with the movement of the link latch 72 towards the front. This shifting is stopped at the shifting distance for one pellet holder 2. At this time, at the upper surface opening 50 of the pellet hole 5, the pellet holder 2 that is next pushed along engages with the recessed curved surface 60 of the pellet holder stop 6, the center of the upper surface opening of the pellet hole 5 and the center of the pellet holder 2 are made to coincide, and the movement is stopped.

All of the pellet holders 2 can then be sequentially pushed along so as to shift within the pellet holder path 20 by pushing single pellet holders 2 with the end of the link latch 72. All of the pellet holders 2 are thus made to rotate by sequentially repeating this operation.

Next, a description is given based on FIG. 23 to FIG. 27 of the operation of an air gun of this embodiment of the invention. FIG. 23 to FIG. 27 are front views of the operating portions of the air gun viewed from the left, with the trans link 11 fixed at a front end by the forearm (foregrip) 18 and by a screw.

Figure 23:
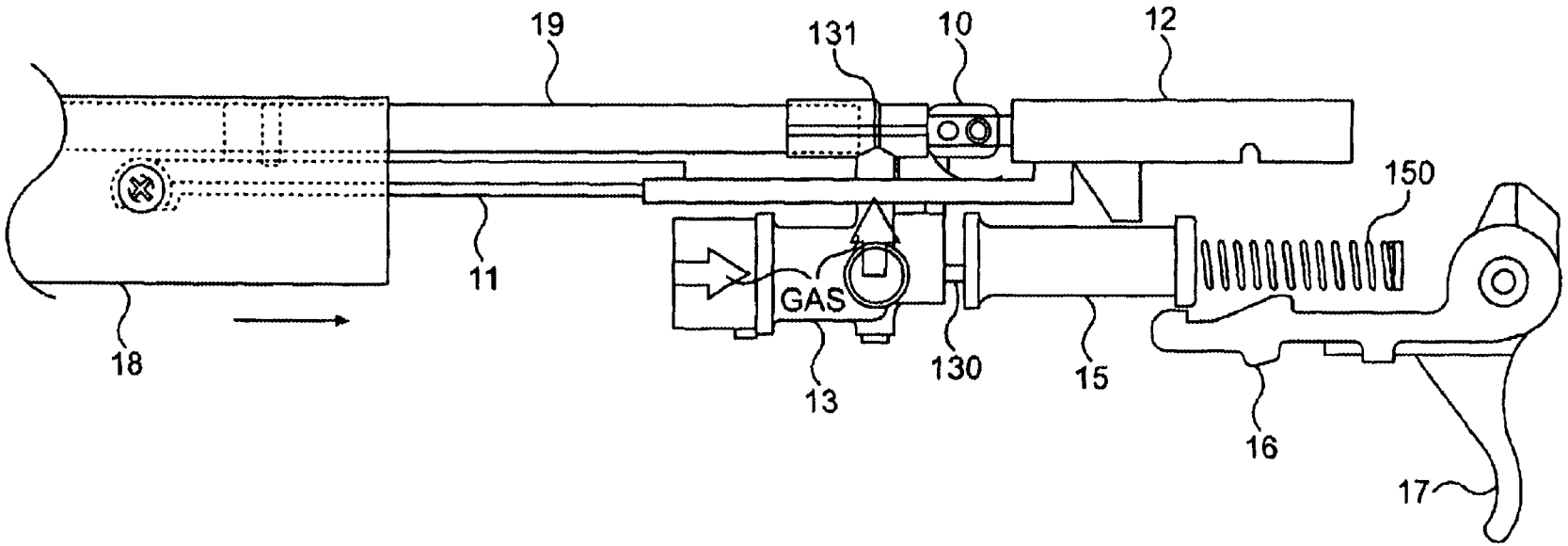
FIG. 23 is a front view showing operating portions of the air gun for this embodiment of the invention.

From the state in FIG. 23, as a result of the marksman gripping the forearm (foregrip) 18 and manually pulling to the rear, the trans link 11 and the bolt 12 move in unison towards the rear.

Figure 24:
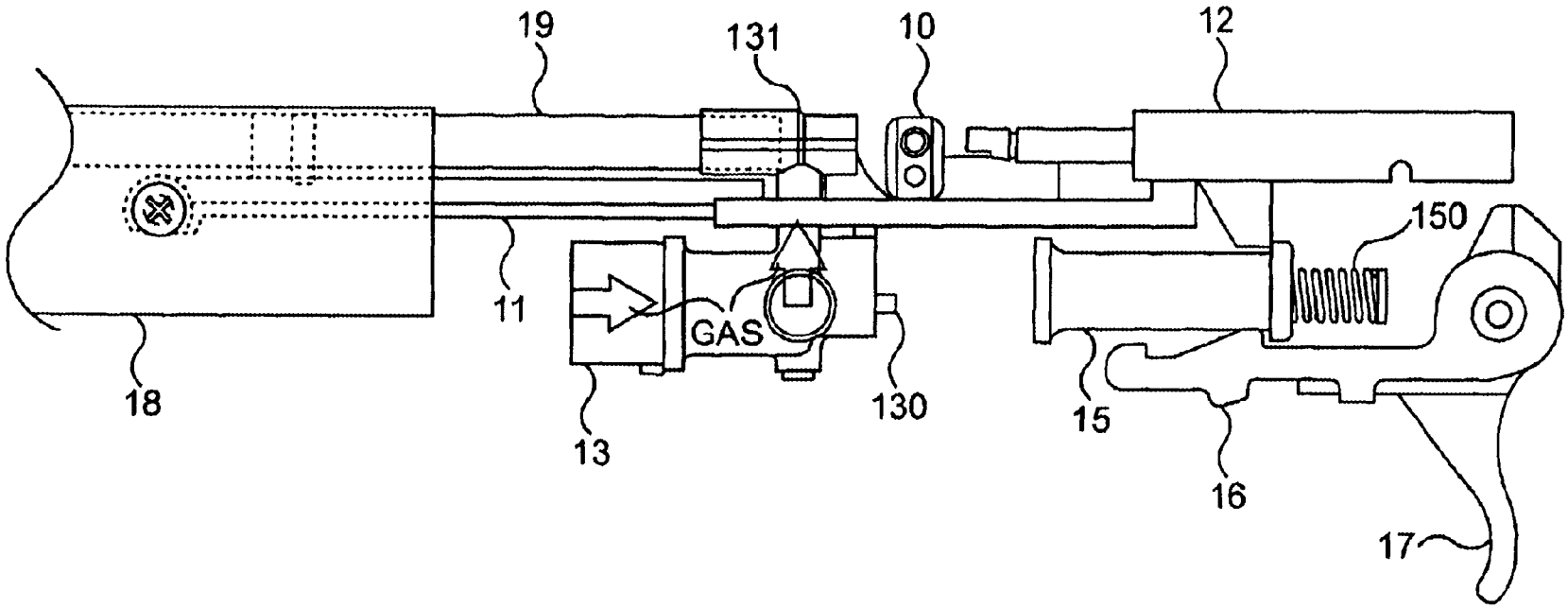
FIG. 24 is a front view showing the same air gun operating portions.

The lower part of the retracted bolt 12 then collides with the brim of the hammer 15 and the hammer 15 retracts while compressing the hammer spring 150 that is urging in a forward direction. The brim of the hammer 15 then engages with a sear 16 interlocked with the trigger 17, and the hammer 15 is held in this state (FIG. 24).

Figure 25:
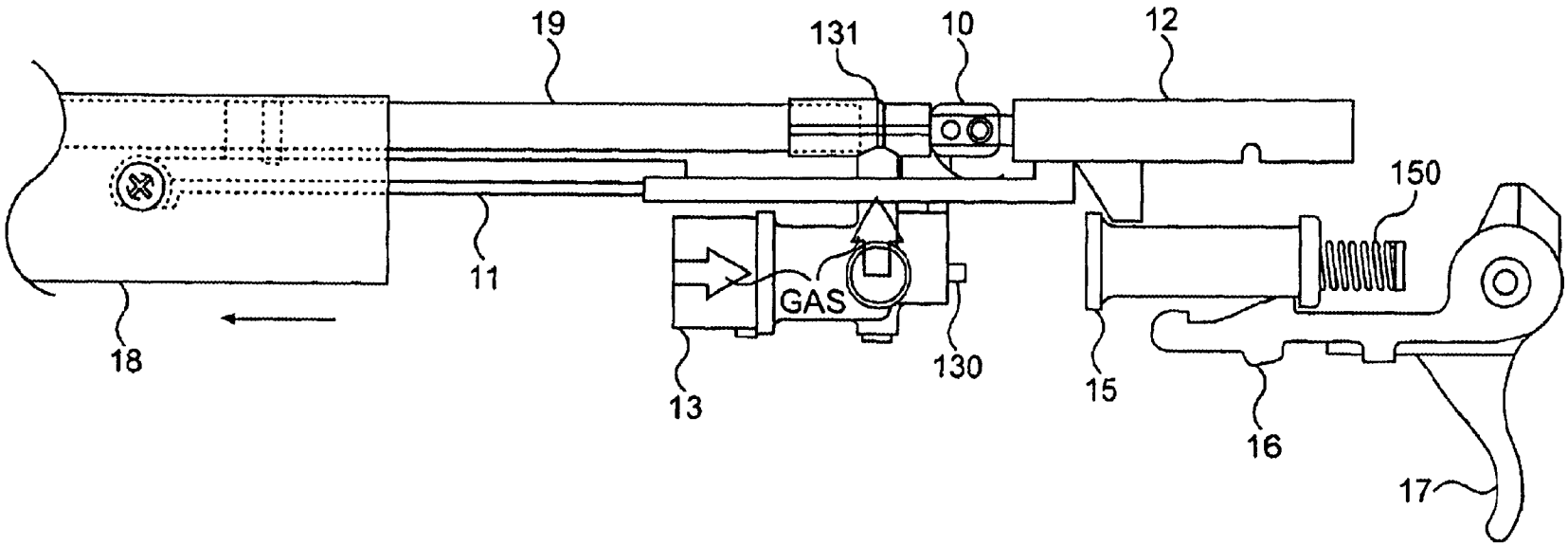
FIG. 25 is a further front view showing the same air gun operating portions.

The marksman then immediately pushes the forearm (foregrip) 18 back to the front, and the fixed trans link 11 and bolt 12 move towards the front in an interlocked manner. However, the hammer 15 which is engaged with the sear 16 remains held in a stationary state towards the rear, with the hammer 15 being urged towards the front by the hammer spring 150 (FIG. 25).

Figure 26:
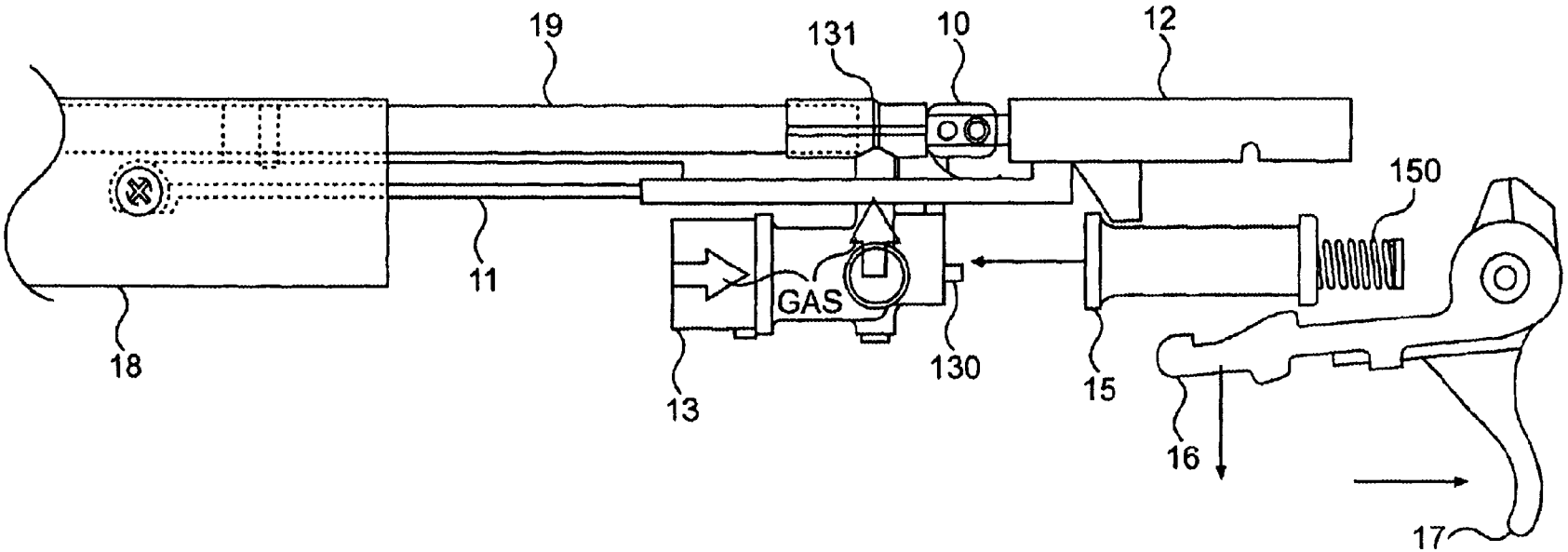
FIG. 26 is another further front view showing the same air gun operating portions.

When a marksman then manually pulls the trigger 17 to the rear using a manual discharging operation, the sear 16 interlocked with the trigger 17 rotates downwards, the brim of the hammer 15 engaging with the sear 16 comes out, and the hammer 15 is made to advance in a powerful manner towards the front due to the urging force of the hammer spring 150 (FIG. 26).

Figure 27:
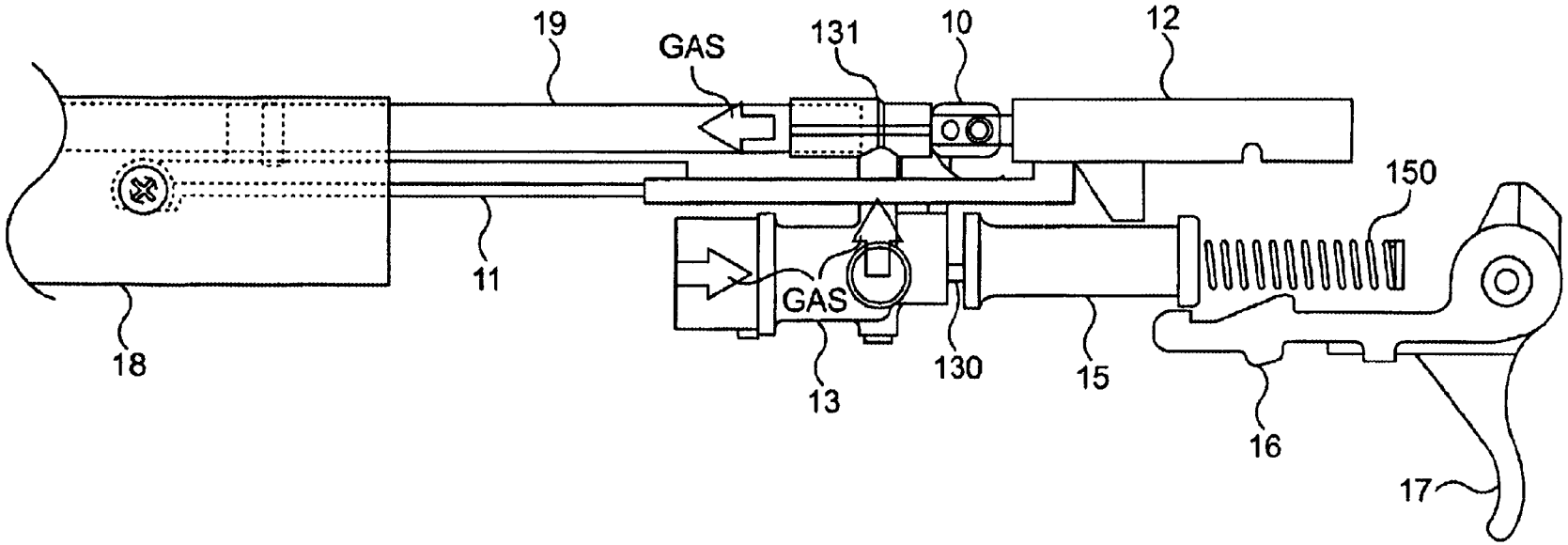
FIG. 27 is a still further front view showing the same air gun operating portions.

The front end of the forcefully advancing hammer 15 then strikes a valve pin 130 projecting further to the rear than the valve body assembly 13, compressed gas is discharged from the compressed gas jet hole 14, and the pellet 200 within the chamber 131 of the valve body assembly 13 is discharged from the barrel (FIG. 27).

The valve pin 130 is urged towards the rear by a valve spring built-into the valve body assembly 13. When the valve body assembly 13 is pushed in by a blow from the hammer 15, after a path is opened up for the compressed gas, when the pressure of the hammer 15 disappears, the hammer is again made to fly out due to the urging force of the valve spring.

It is then possible for a marksman to make the air gun discharge pellets 200 sequentially from the magazine M by repeating this operation.

What is claimed is:

1. A air gun having a magazine and a rotary sub chamber:

wherein the magazine comprises:

a magazine body;

a plurality of pellet holders capable of being inserted with pellets;

a pellet holder path capable of rotating the plurality of pellet holders in an endless manner;

a pellet hole open to a lower surface of the pellet holder path so as to be capable of coinciding with one pellet holder;

a shutter capable of opening and closing the pellet hole;

a conveyor link interlocking with the shutter; and a link latch, interlocking with shifting of the conveyor link and shifting one pellet holder in one direction at the time of movement in one direction, and not shifting the pellet holders at the time of movement in the opposite direction so that the pellet holder path is caused to rotate in one direction;

wherein a rotary sub chamber positioned at a lower part of the magazine body is attached to the air gun body in such a manner as to be freely rotatable about a sub chamber rotary axis and comprises:

a sub chamber arm parallel with the sub chamber rotary axis; and a rotary pellet hole constituted by a through-hole;

wherein the rotary sub chamber is rotated by a backwards and forwards shifting trans link fitted to the air gun body so that the direction of the angle of the rotary pellet hole can be changed from a direction coinciding with the barrel to a direction coinciding with the pellet hole of the magazine;

and the magazine conveyor link is also interlocked so as to move to the front and rear in unison with movement to the front and rear of the trans link.

* * * * *